US009118139B1

(12) United States Patent
Flegel et al.

(10) Patent No.: US 9,118,139 B1
(45) Date of Patent: Aug. 25, 2015

(54) FLIP LID INTERLOCK

(71) Applicant: Reliance Controls Corporation, Racine, WI (US)

(72) Inventors: Michael O. Flegel, Racine, WI (US); Jeffrey P. Baldwin, Phoneix, AZ (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 14/203,976

(22) Filed: Mar. 11, 2014

Related U.S. Application Data

(60) Provisional application No. 61/789,097, filed on Mar. 15, 2013.

(51) Int. Cl.
*H01R 13/70* (2006.01)
*H01R 33/94* (2006.01)
*H01R 13/447* (2006.01)

(52) U.S. Cl.
CPC ..... *H01R 13/447* (2013.01)

(58) Field of Classification Search
CPC .... H01R 33/9555; H01R 13/70; H01R 33/94; H01R 29/00; H01H 27/06
See application file for complete search history.

(56) References Cited

U.S. PATENT DOCUMENTS 3,634,804 A * 1/1972 Mineo ..... 337/206
3,694,790 A 9/1972 Martin
4,477,143 A 10/1984 Taylor
5,241,143 A * 8/1993 Adams ..... 200/51.05
5,322,449 A 6/1994 Pizano
5,722,847 A 3/1998 Haag
5,761,027 A * 6/1998 Flegel ..... 361/664
5,902,150 A 5/1999 Sigl et al.
6,121,897 A * 9/2000 Flegel ..... 340/907
6,166,525 A 12/2000 Crook
6,193,548 B1 2/2001 Sigl et al.
6,350,139 B1 2/2002 Haag
6,358,076 B1 3/2002 Haag
6,424,060 B1 7/2002 Shiely et al.
6,504,268 B1 1/2003 Flegel
6,525,541 B1 2/2003 Leopold
6,788,504 B2 9/2004 Vanderkolk
6,796,814 B1 * 9/2004 Handschke ..... 439/142
6,979,787 B2 12/2005 Davies
7,110,534 B1 * 9/2006 Mullaney et al. ..... 379/428.01
7,569,785 B2 8/2009 Mills et al.
7,575,467 B2 8/2009 Ferguson et al.
7,604,246 B2 10/2009 Sodemann et al.
8,810,081 B1 * 8/2014 Flegel et al. ..... 307/328
2002/0180451 A1 12/2002 Leopold et al.
2005/0122650 A1 6/2005 Beasley, III et al.

(Continued)

FOREIGN PATENT DOCUMENTS

JP 2010277718 12/2010

*Primary Examiner* — Gary Paumen
(74) *Attorney, Agent, or Firm* — Boyle Fredrickson, S.C.

(57) ABSTRACT

A flip lid interlock that disables or locks out operation of non-GFCI duplex receptacles when, a generator is coupled to the wiring system of a building (and therefore is grounded). When the power cord that is interconnected with the building wiring system is engaged with the multipole locking receptacle, the flip lid is in an open position and prevents an electrical device from being powered by the generator using the duplex receptacles. When the power cord is not connected to the multipole locking receptacle, the flip lid is in a closed position and allows an electrical device to be powered by the generator using the duplex receptacles.

18 Claims, 11 Drawing Sheets

(56) References Cited

U.S. PATENT DOCUMENTS

2006/0146581 A1 7/2006 Murphy
2006/0270280 A1 11/2006 Sodemann et al.
2007/0086126 A1* 4/2007 Baxter ..... 361/42
2007/0252435 A1* 11/2007 Coe et al. ..... 307/10.1
2008/0079264 A1 4/2008 Serdynski et al.
2008/0265844 A1 10/2008 Smith et al.
2011/0095540 A1 4/2011 Jackson et al.

* cited by examiner

FLIP LID INTERLOCK

CROSS-REFERENCE TO RELATED APPLICATIONS

This application claims priority to U.S. provisional application Ser. No. 61/789,097, filed Mar. 15, 2013, the entire contents of which is incorporated herein by reference.

BACKGROUND OF THE INVENTION

The present invention relates generally to electrical generators that can provide backup electrical power to an electrical system or that can be used as a stand-alone power supply for powered accessories, such as power tools. More particularly, the present invention is directed to a flip lid which covers a receptacle or socket of an electrical generator and allows or prevents electrical power flow through other receptacles via the pivoting movement of the cover between an open and closed position.

In today's electrical supply systems, there are occasions when alternate sources of electrical power are necessary or desirable. For example, the capability of switching from utility power to emergency generator power is extremely important for many businesses, hospitals and industries, as well as residential dwellings. Engine driven electrical generators are commonly used to provide backup or emergency electrical power in those instances when utility power is interrupted. Additionally, portable electrical generators allow electrical power to be provided at locations where utility power is not available.

Portable electrical generators will typically have a dedicated receptacle or socket that is designed for larger loads and to engage with a power cord that is electrically coupled either to the electrical system of the building, typically through a transfer switch and panel, or to some other distribution system such as a distribution box for a number of cord connected devices. For most portable electrical generators, a multipole locking receptacle is used to engage and lock the male end of the power cord to prevent accidental disconnection of the power cord from the electrical generator. Via the interconnection of the male end of the power cord with the multipole locking receptacle or socket, the live conductors of the electrical generator will be electrically connected to appropriate poles of the transfer switch and panel. When connecting a floating neutral generator to a building's wiring system as a non separately derived system, the neutral conductor will be electrically connected to the neutral bus of the service entrance or main panel generally through the transfer panel and the ground conductor will be connected to the ground bus of the service entrance or main panel also generally via the transfer panel. Thus, the electrical generator is "grounded" via electrical connection with the ground bus of the service entrance or main panel.

In a non-separately derived arrangement such as that described above, when a bonded neutral electrical generator is supplying electrical power to one or more loads of the building through the building wiring system, electrical current will return via the neutral conductor of the load to the neutral bus conductor of the main electrical panel. A first portion of electrical current then flows from the neutral bus conductor of the building back to the neutral conductor of the generator, thus completing a circuit path. A remaining portion of electrical current flows from the neutral bus conductor of the building to a neutral-to-ground tie bar at the electrical panel, through the grounding bus conductor, back through the safety ground-to-neutral bonding conductor of the generator, and then through the neutral conductor of the generator, completing another circuit path. As provided in the United States National Electrical Code, Article 250, a power system should be electrically grounded in such a manner that prevents a flow of electrical current via the neutral conductor of the building back to the safety grounding conductor of the generator, in all situations except for an electrical power fault (q.v., Article 250 of the National Electrical Code). The safety grounding conductor is expected to be pristine or absent of the normal flow of electrical current, and instead is to be used to conduct electrical current safely to ground only when there is an electrical fault occurrence. Thus, the use of bonded neutral generators to supply backup electrical power to the electrical system of a home or other building requires a system that switches the neutral, known as a separately derived system. This system is more costly to buy and install.

Portable electric generators will typically have one or more duplex receptacles in addition to the multipole locking receptacle for receiving the male end of an extension cord or the power cord of an electrical device. As known in the art, the duplex receptacles allow electrical devices to be powered directly by the electrical generator rather than through a building wiring system. In most instances, the duplex receptacles are designed to receive a three-prong plug of a power cord. In this regard, each socket of the duplex receptacle is designed to receive a hot conductor, neutral conductor, and ground conductor of a conventional male end of a three-prong plug. As is known, each socket of the duplex receptacle is also capable of receiving a non-grounded plug of a power cord.

Floating neutral electrical generators are typically not grounded, i.e., not only is the neutral not connected to the safety ground but the safety ground is also not connected to earth because the generator frame is not conductively connected to earth such as through a grounding rod. As a result, when the generator is used as a stand-alone power supply or providing electrical power directly to one or more electrical devices without an electrical connection to the electrical wiring system of the building, ground fault protection is unnecessary because a path for current to flow back to the generator does not exist through the ground. In other words, ground fault protection is built into the system through isolation of the neutral wire from the ground thereby eliminating the need for duplex receptacles incorporating ground fault circuit interrupter (GFCI) devices. However, when a floating neutral generator is connected to the electrical system of a building, the generator becomes grounded through its electrical connection to the electrical system of the building. As a result, there can be a ground fault risk when a floating neutral generator is connected to the electrical system of a building. One way to reduce this risk on floating neutral generators is to equip them with duplex receptacles that include GFCI devices, which can be costly and are only needed when the generator is connected to a building.

Increasingly, professionals and homeowners have demanded a single generator capable of being used for both construction and for backup power supply for the electrical system of a home, apartment, or other building when utility power is interrupted. They all would prefer to install the generator in a non separately derived, system as this is the most common and economical installation. For a floating neutral generator to accomplish this task, costly GFCI protected duplex receptacles should be used for ground fault protection when the generator is connected to the electrical system of the home or building. Since bonded neutral generators internally bond the neutral and ground conductors, costly GFCI devices are also used to provide ground fault protection primarily in construction applications where they are now required by the NEC. Moreover, it has been found that connecting a bonded neutral generator to the electrical system of a home or building as a non separately derived system can result in "false" triggering of ground faults. That is, the flow of electrical current to the safety grounding conductor of the generator has been known to trigger a ground fault circuit interrupter at the generator. When triggered, the ground fault circuit interrupter will de-energize the live conductors of the generator and prevent the supply of electrical power to the circuits connected to the transfer equipment. To avoid this nuisance tripping of the GFCI, the consumer must un-tie the bonding of the generator neutral and the generator ground. Many consumers are hesitant to tackle such a task and, moreover, it requires the consumer to remember to retie the generator neutral and the generator ground when the electrical generator is used to power electrical equipment directly rather than through the wiring of the home or building.

An interlock arrangement has been developed that allows a floating neutral electrical generator having a receptacle, such as a duplex receptacle, absent GFCI protection to be safely used to provide electrical power to the electrical system of a home or other building during utility power interruption. The interlock arrangement is described in co-pending application Ser. No. 13/038,881 filed Oct. 14, 2010 entitled "Interlock Arrangement for Controlling the Neutral Output of a Portable Generator", the entire contents of which are hereby incorporated by reference. In this system, the duplex receptacles cannot be used to power tools or other electrical devices when the generator is connected to supply power to the electrical system of the home or building. However, when the generator is physically disconnected from the electrical system of the home or building, the interlock arrangement exposes the duplex receptacles thereby enabling their use.

The present invention seeks to improve upon the prior art by providing a novel apparatus which prevents electrical power flow through selected receptacles by the opening and closing of a flip lid covering receptacles designed to interconnect with the electrical system of a building.

It is therefore an object of the present invention to utilize the mechanical action of a flip lid during normal operation of a portable generator to provide built in ground fault protection.

SUMMARY OF THE INVENTION

The present invention provides a flip lid which covers a receptacle or socket of an electrical generator, such as a multipole locking receptacle, and which prevents access to a duplex receptacle when the electrical generator is coupled to a power cord used to transfer electrical power from the generator to the electrical system of the building. More particularly, the flip lid includes a contact arrangement which prevents the transfer of electrical power to duplex receptacles when the lid is open and the electrical generator is coupled to a power cord, but allows the transfer of electrical power to duplex receptacles when the lid is closed and the electrical generator is not coupled to a power cord. In other words, when a power supply is engaged with the multipole locking receptacle, the arrangement prevents transfer of electrical power to the non-grounded receptacles, and when a power supply is disengaged with the multipole locking receptacle, the arrangement allows transfer of electrical power to the non-grounded receptacles.

In one embodiment an electrical generator is provided having a means for generating electrical power. The generator has a first receptacle that is connectable to the power generating means and is also adapted to engage a power plug associated with an electrical panel that controls the flow of electrical current to a plurality of loads. The generator has a second receptacle that is connectable to the power generating means and adapted to engage a power plug of an electrical device. The generator includes a contact armature that is interconnected between the first receptacle, second receptacle, and the power generating means that is movable between a first position and a second position. In the first position, the first receptacle is electrically connected to the power generating means to receive electrical power and the second receptacle is electrically disconnected from the power generating means. In the second position, the first receptacle is electrically disconnected from the power generating means and the second receptacle is electrically connected to the power generating means to receive power from the power generating means. A flip lid covers the first receptacle and is configured to move the armature between the first position when the lid is open and the second position when the lid is closed.

In one aspect a hinge pin permits rotation of the flip lid between the open and closed positions and is simultaneously rotatable with the lid to actuate movement of the contact armature between the first and second position. The hinge pin may be provided with a protrusion that acts on a plunger adapted to actuate the contact armature for movement between the first and second positions. The plunger may retract to place the contact armature in the first position, or alternatively may extend to place the contact armature in the second position.

In one aspect the first receptacle is a multipole receptacle and the second receptacle is a non-GFCI receptacle.

The present invention also provides a lockout arrangement to prevent simultaneous use of a main receptacle and an auxiliary receptacle of a portable generator. A cover is associated with the main receptacle and is rotatable between an open and a closed position to selectively disconnect power supply to a duplex receptacle. A plunger coupled to and associated with rotation of the cover disconnects power to the duplex receptacle when the cover is open and the plunger is retracted, and connects power to the duplex receptacle when the cover is closed and the plunger is extended.

The present invention also provides a method of preventing simultaneous use of a main receptacle and an auxiliary receptacle of a portable generator by providing a lockout arrangement having a cover pivotably coupled to the main receptacle and a plunger slidably disposed within a hinge of the cover and movable to selectively allow current flow to provide power to the auxiliary receptacle when the cover is closed and to prevent power to the auxiliary receptacle when the cover is open. The method involves coupling a power cord to the main receptacle so that power to the auxiliary receptacle is prevented and disconnecting the power cord from the main receptacle so that power to the auxiliary receptacle is provided.

These and other features and aspects of the present invention will be better appreciated and understood when considered in conjunction with the following description and the accompanying drawings. It should be understood, however, that the following description, while indicating a representative embodiment of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
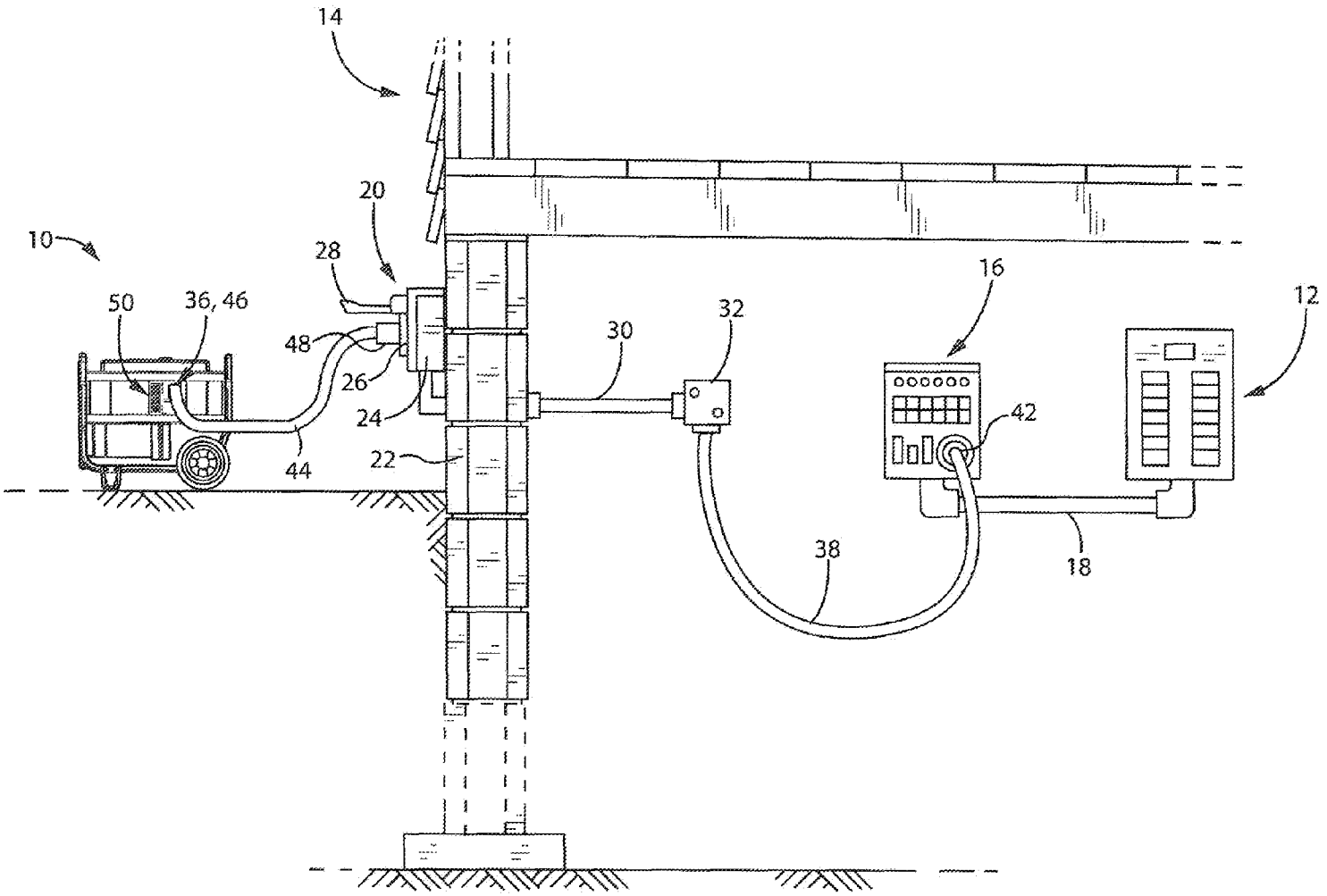
FIG. 1 is a schematic representation showing a power management system for switchably providing electrical power from a utility and an auxiliary power supply, such as a portable electrical generator, to a load center or electrical panel associated with a building.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE DRAWINGS

The various features and advantageous details of the subject matter disclosed herein are explained more fully with reference to the non-limiting embodiment described in detail in the following description.

This invention relates generally to electrical generators that can provide backup electrical power to an electrical system or that can be used as a stand-alone power supply for powered accessories, such as power tools. More particularly, the present invention is directed to a flip lid interlock system for selectively disabling outputs of an electrical generator based on the positioning of the flip lid cover. The flip lid interlock system utilizes the rotation of the flip lid to actuate an electrical contact arrangement located adjacent the flip lid.

FIG. 1 shows a power inlet arrangement for interconnecting a portable generator 10 with a main electrical panel or load center 12 located in the interior of a building 14. In the power inlet arrangement of FIG. 1, a power transfer panel 16 is mounted adjacent the main panel 12, and is interconnected therewith via a series of wires enclosed by a conduit 18 extending between main panel 12 and transfer panel 16. Transfer panel 16 may illustratively be a panel such as that manufactured by Reliance Controls Corporation of Racine, Wis.

A power inlet box 20 is mounted to the wall of building 14, shown at 22. Power inlet box 20 includes an external housing including a series of walls such as 24, and a receptacle 26 mounted to a front wall of the housing. A cover 28 is mounted to the front wall of the housing via a hinge structure, and is movable between an open position as shown in FIG. 1 and a closed position in which cover 28 encloses receptacle 26 when not in use. A conduit 30 extends between inlet box 20 and a junction box 32, and a flexible cord 38 is attached at one end to junction box 32. At its opposite end, flexible cord 38 has a connector 42 engageable with a power inlet receptacle provided on transfer panel 16. Appropriate wiring and connections are contained within inlet box 20, conduit 30 and junction box 32 for providing an electrical path between inlet box 20 and transfer panel 16 when flexible cord 38 is engaged with the inlet receptacle of transfer panel 16. It is understood that this representation shows but one example of the manner in which backup power can be supplied to the electrical system of a building, and that numerous other arrangements may be employed.

A power cord 44 extends between generator 10 and power inlet box 20. Cord 44 includes a plug 36 at one end, which is engageable with the power outlet of generator 10. As will be described more fully below, the electrical generator 10 has a multipole locking receptacle 46 with which the plug 36 is engaged and locked, in order to electrically connect the generator 10 to the power inlet box 20. Cord 44 further includes a connector 48 at the end opposite plug 36. Connector 48 is engageable with receptacle 26 for transferring power generated by generator 10 to power inlet box 20, which is then supplied through the wiring in conduit 30, junction box 32, flexible cord 38 and connector 42 to transfer panel 16, and from transfer panel 16 through the wiring in conduit 18 to main panel 12. In this manner, generator 10 functions to provide power to selected circuits of main panel 12 during a power outage. In this arrangement, the user first connects flexible cord 38 to the power input of transfer panel 16 utilizing connector 42, and then exits the building, connects cord 44 between generator 10 and power inlet 20, and then commences operation of generator 10.

In addition to the aforementioned multipole locking receptacle 46, the electrical generator 10 also includes duplex receptacles 50 that allow the electrical generator 10 to provide electrical power to one or more power accessories or extension cords when such accessories or cords are plugged into the duplex receptacles 50. As will be described, the electrical generator 10 includes structure that prevents simultaneous supply of power to the multipole locking receptacle 46 and the duplex receptacles 50.

Figure 2:
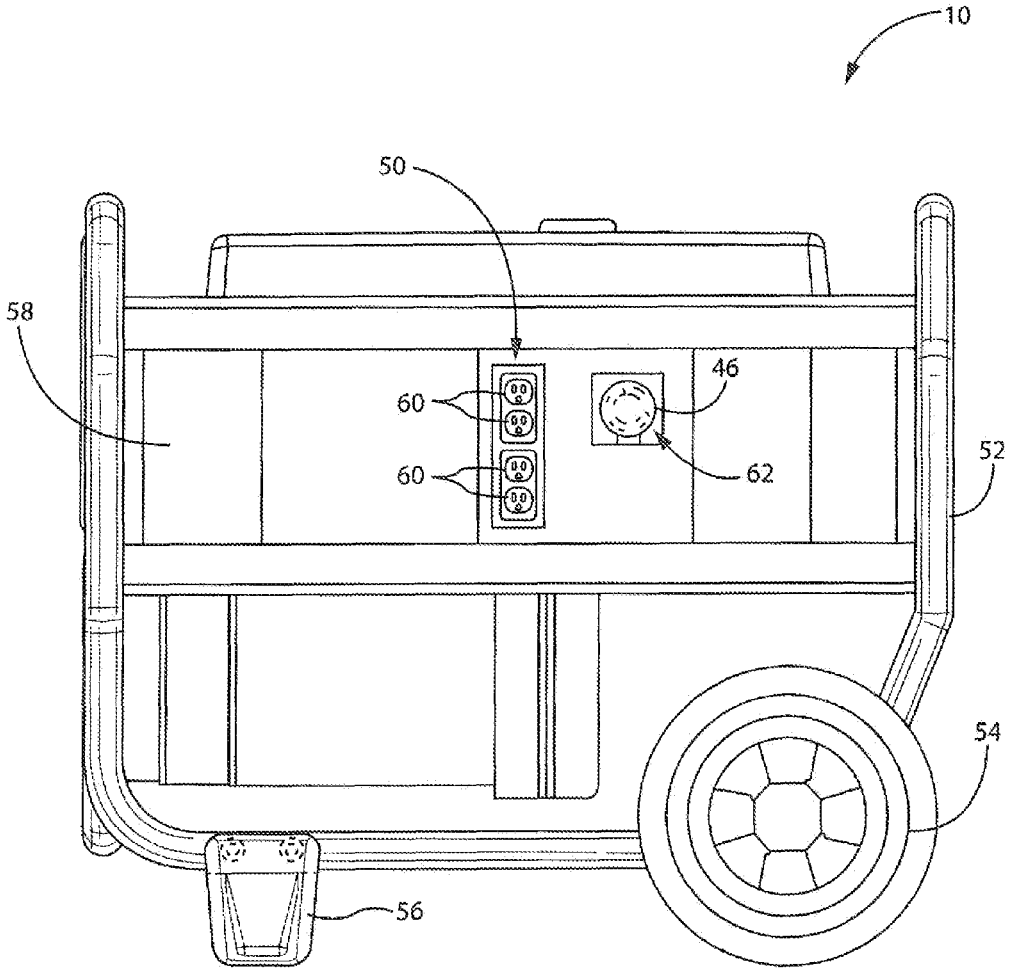
FIG. 2 is a side elevation view of the electrical generator for use with the power management system of FIG. 1 according to one aspect of the invention.

Turning now to FIG. 2, the electrical generator 10 is designed to be a portable power supply and thus has a frame 52 supported by wheels 54. Forward of the wheels 54 are feet 56 that are mounted to a lower portion of the frame 52 and provide stability for the electrical generator 10 when placed in position. As known in the art, the electrical generator 10 has an internal combustion engine (not shown) enclosed within a housing structure 58 that is carried by the frame 52 in a conventional manner. The internal combustion engine creates mechanical energy that is converted in a known manner to electrical energy that is made available at multipole locking receptacle 46 and duplex receptacle 50. In contrast to conventional electrical generators, the present invention provides an electrical generator 10 having structure that prevents simultaneous supply of electrical power to the multipole locking receptacle 46 and the duplex receptacles 50. In this regard, when the multipole locking receptacle 46 is being used to feed electrical current to power cord 44, as seen in FIG. 1, electrical accessories or devices cannot be powered through the duplex receptacles 50. Similarly, when electrical accessories or devices are plugged into the duplex receptacles 50, electrical power cannot be provided to the power cord 44.

The electrical generator 10 may have a pair of duplex receptacles 50; however, it is understood that the generator 10 may have any number of duplex receptacles. In addition, it is understood that the generator 10 may have receptacles other than duplex receptacles, although it is understood that duplex receptacles are most commonly employed. Each duplex receptacle 50 may include a pair of outlets or sockets 60 that are stacked vertically. The sockets 60 could also be oriented horizontally. The sockets 60 are mounted to the housing 58 in a conventional manner and are located generally adjacent the multipole locking receptacle 46. As known in the art, each socket 60 typically has a live conductor, a neutral conductor, and a ground conductor. In one embodiment, the neutral conductors for each of the sockets 60 are not connected to the generator frame 52. The generator frame 52 itself is typically not grounded (connected to Earth) so, in accordance with the invention, the duplex receptacles 50 do not have GFCI devices. That is, when the generator is used without an electrical connection to the building wiring system. GFCI protection is not needed because a path for current to flow back to the generator does not exist through the ground. Essentially, ground fault protection is built into the system through isolation of the neutral wire from the ground, thus eliminating the need for a GFCI device. The multipole locking receptacle 46, on the other hand, is only used when providing electrical power to the building wiring system and is afforded ground fault protection via that connection. However, when the generator 10 is electrically connected to the building wiring system, the generator neutral becomes connected to the ground. Conventional electrical generators can avoid ground faults in such an instance by relying upon a GFCI device, which is relatively costly. As will be described more fully below, the present invention avoids the need for such a GFCI device by locking out use of the duplex receptacles 50 when the electrical generator 10 is coupled to power cord 44.

The present invention provides a flip lid interlock that disables or locks out operation of the non-GFCI duplex receptacles 50 when the generator 10 is coupled to the wiring system of a building (and therefore is grounded). In other words, when the power cord 44 that is interconnected with the building wiring system is engaged with the multipole locking receptacle 46, the lockout arrangement disables or locks out operation of the sockets 60 and thus prevents an electrical device from being powered by the generator 10 using the duplex receptacles 50. Thus, the non-grounded receptacles 50 cannot be used when the multipole locking receptacle 46 is connected to power cord 44. On the other hand, when the electrical generator 10 is not connected to power cord 44, the outlets 50 are available for use.

Figure 3:
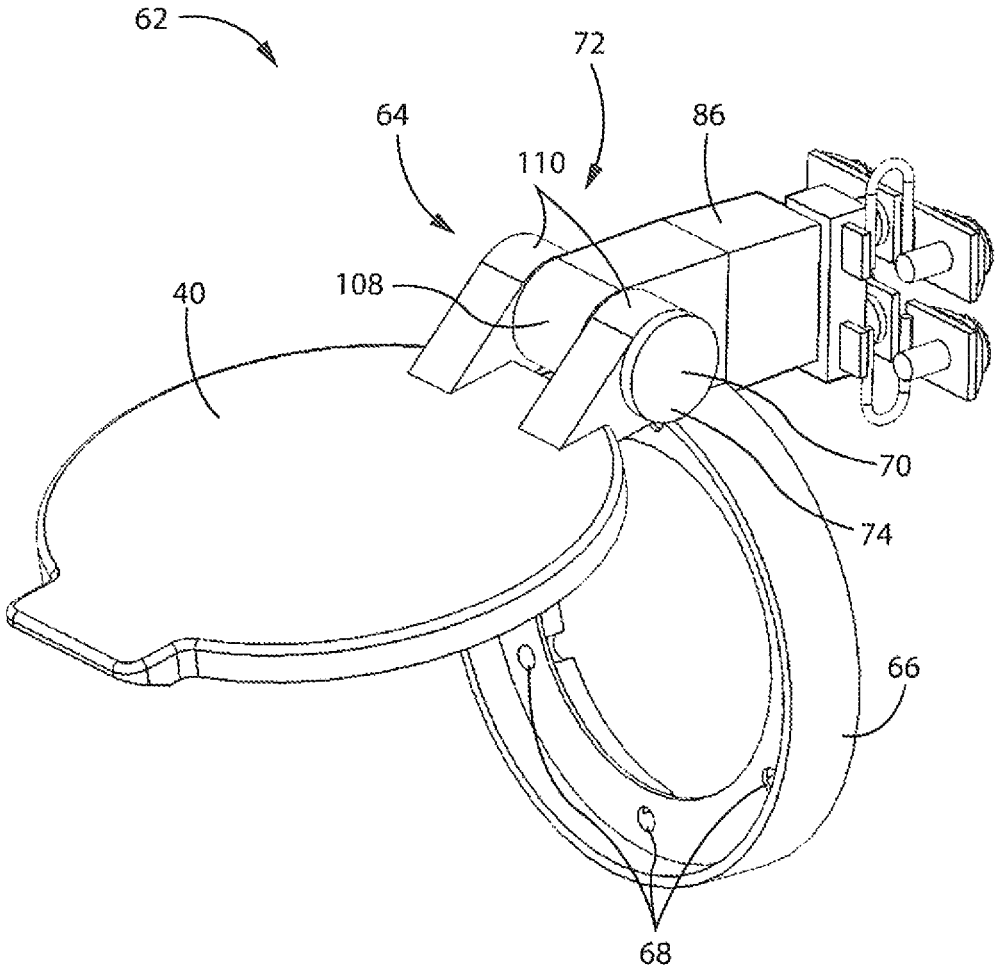
FIG. 3 is an isometric view of a contact and lid assembly covering a receptacle of the electrical generator of FIG. 2 and removed from the power management system and showing the access cover in an open position and the contact assembly positioned behind the lid assembly and in a deactivated position.
Figure 4:
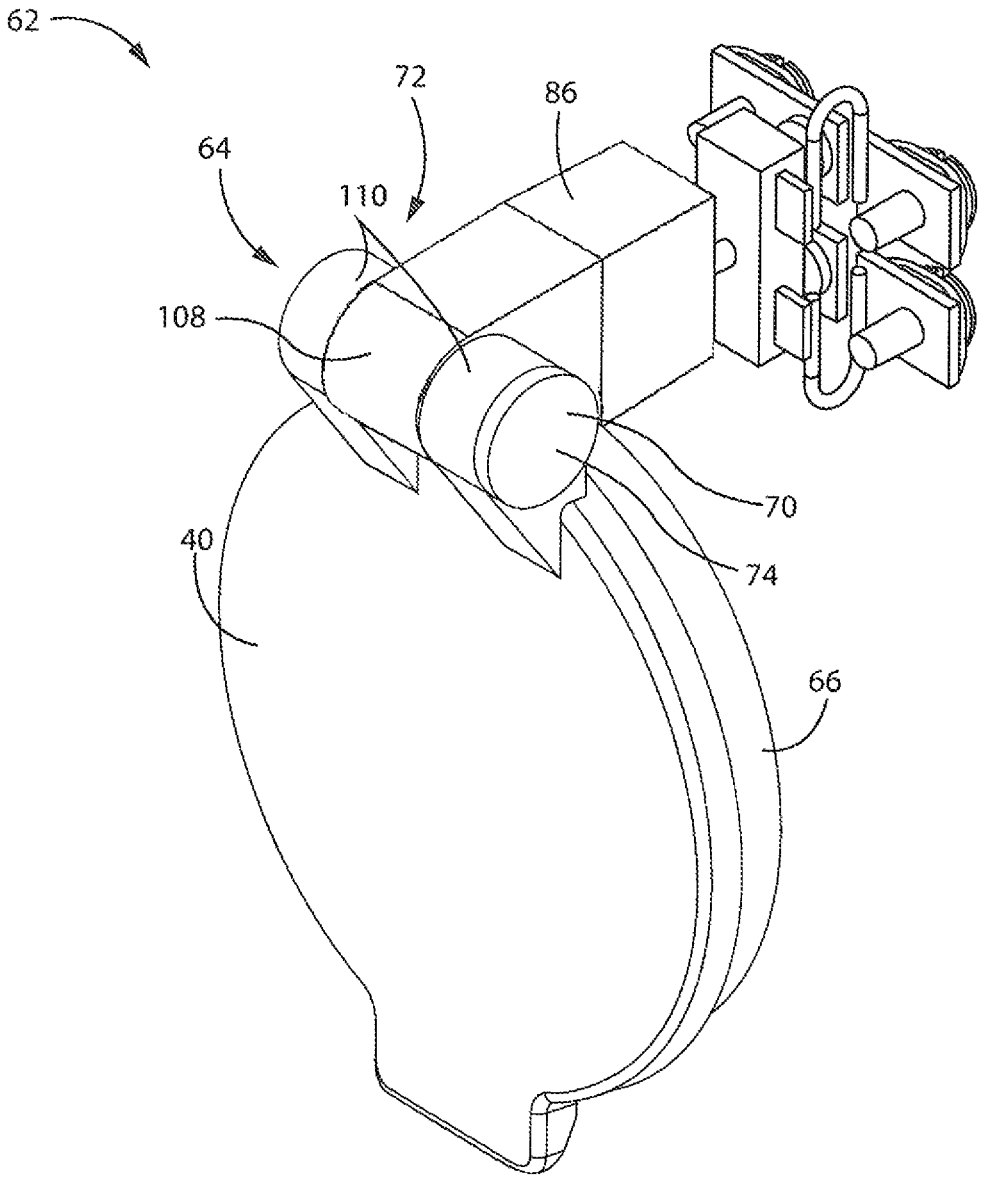
FIG. 4 is an isometric view of the contact and lid assembly of FIG. 3 showing the access cover in a closed position and the contact assembly positioned behind the lid assembly and in an activated position.
Figure 5A:
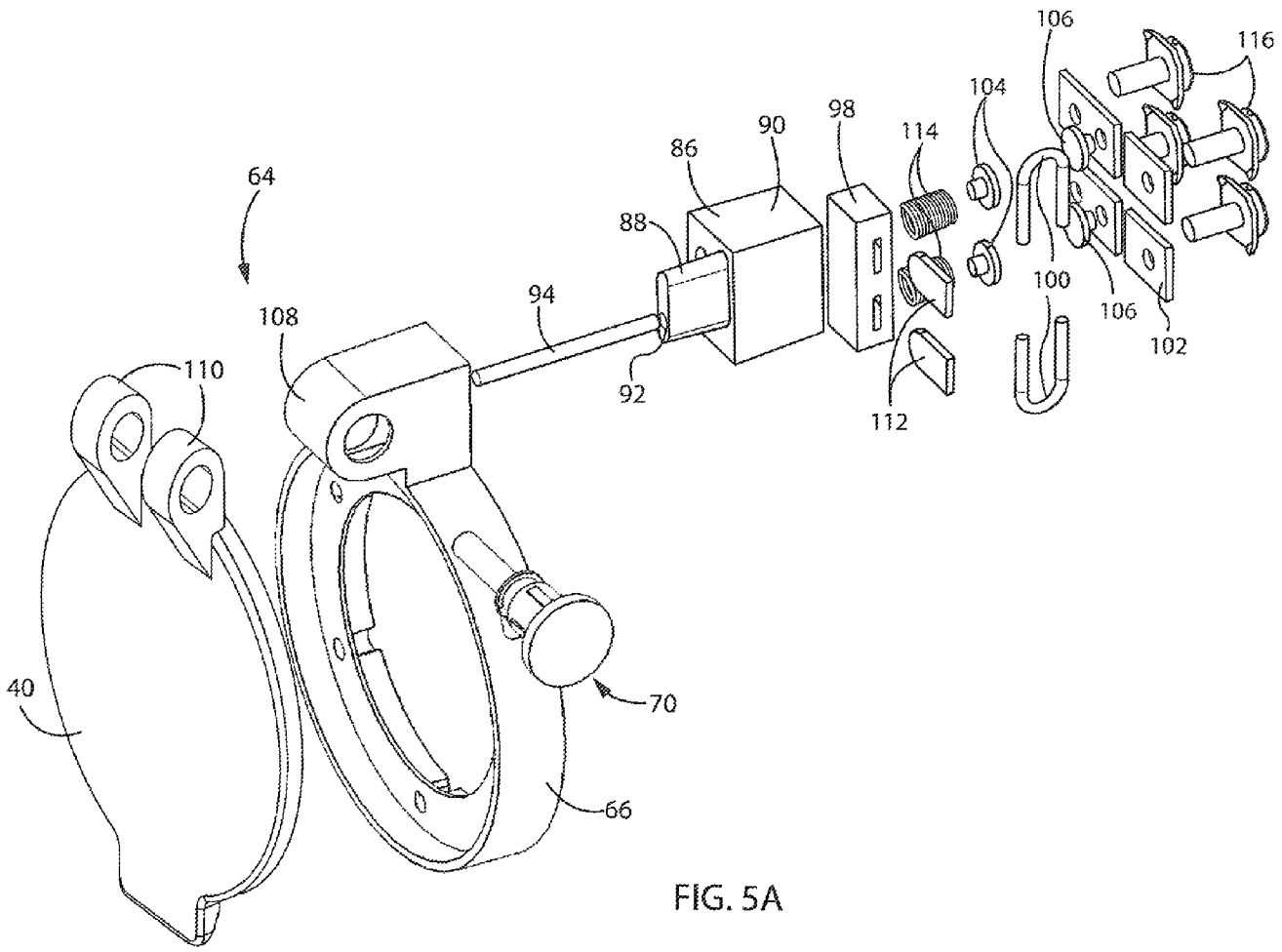
FIG. 5A is an exploded front isometric view of the lid assembly of FIG. 3.
Figure 5B:
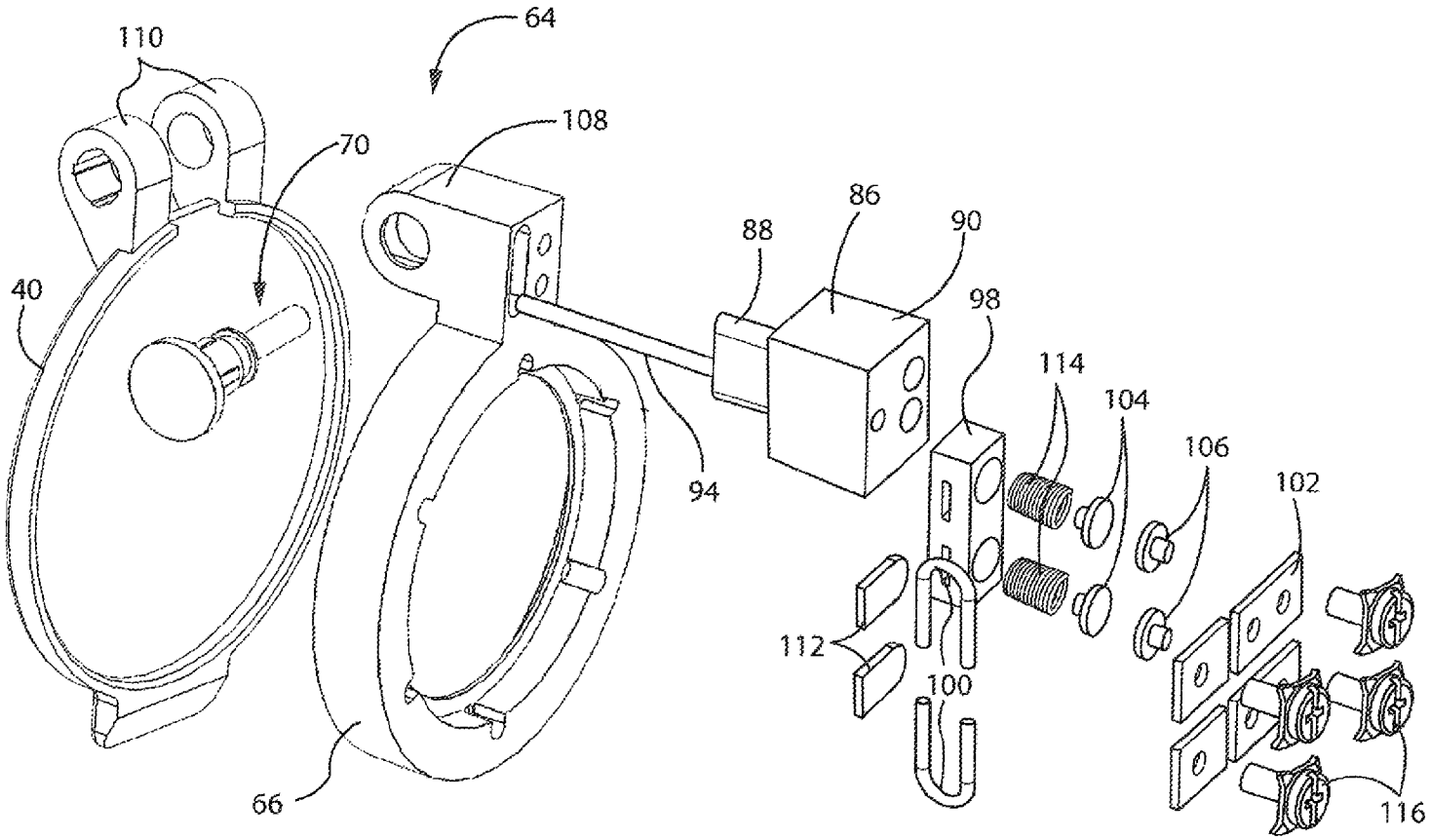
FIG. 5B is an exploded rear isometric view of the lid assembly of FIG. 3.
Figure 6:
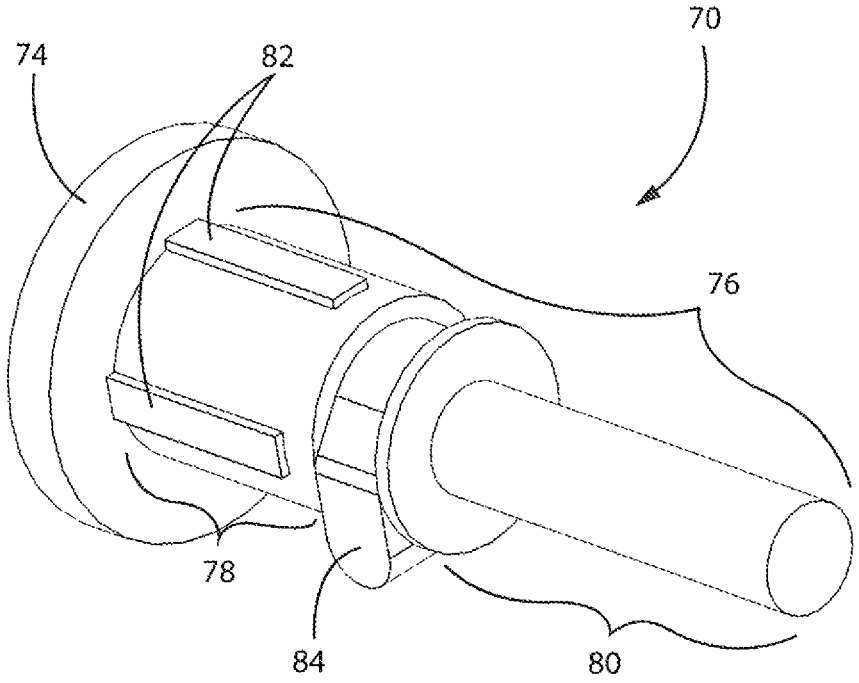
FIG. 6 is an enlarged isometric view of a protrusion of the lid assembly of FIG. 3.

With reference now to FIGS. 2-4, in one embodiment, a flip lid interlock 62 in accordance with the present invention includes a flip lid over 40 that encloses the multipole locking receptacle 46 of the generator 10, wherein opening rotation of the flip lid cover 40 causes disengagement of electrical contacts preventing power from being delivered to the non-GFCI duplex receptacles 50. It is contemplated that flip lid cover 40 may be installed to enclose any receptacle of electrical generator 10, and may prevent power from being delivered to any other receptacle, not only the configuration described herein.

In the illustrated embodiment, the flip lid cover 40 is rotatable between two positions. In a first position, the flip lid cover 40 is in a closed position over the multipole locking receptacle 46 such as when the receptacle 46 is not coupled to a power cord 44. In the second position, flip lid cover 40 is in an open position over the multipole locking receptacle 46 such as when the receptacle 46 is coupled to a power cord 44. Flip lid cover 40 is mounted to a wall of housing 58 containing multipole locking receptacle 46 so as to enclose receptacle 46 when in a closed position. The flip lid cover 40 is attached via a hinge structure 64 having a base 66 that is fixedly attached to the wall by inserting a number of threaded fasteners, e.g., screws, through a number of openings 68 provided in the base 66.

The flip lid cover 40 is pivotable about hinge structure 64 between the closed position, as seen in FIG. 4, and the open position, as seen in FIG. 3. Hinge structure 64 may include a conventional pivot pin 70 defining a pivot axis of flip lid cover 40, and a torsion spring (not shown) for biasing the flip lid cover 40 toward a closed position, in a manner as is known. When flip lid cover 40 is in the closed position, the flip lid cover 40 aligns with base 66 so as to provide a weatherproof seal therebetween. A gasket or other tight seal may define the sealed interaction between the flip cover lid 40 and the base 66.

Referring to FIGS. 3-6, the hinge structure 64 generally regarded as a pin hinge providing a barrel 72 for receiving a hinge pin 70 therein. The hinge pin 70 is inserted into the barrel 72, which consists of a central knuckle 108 connected to base 66, and a pair of outer knuckles 110 connected to flip lid cover 40 and located one on either side of the central knuckle 108 for coupling flip lid cover 40 to base structure 66. The hinge pin 70 has a head 74 disposed outside the barrel 72 and an axle or bearing section 76 disposed within the barrel. The bearing section 76 has a first section 78 adjacent to the head 74, and a second section 80 adjacent to the first section 78. The first section 78 has a diameter less than the diameter of the head 74 for insertable engagement within the barrel 72, and the second section 80 has a diameter less than the first section 78. The proximal end of the first section 78 closest to the head 74 includes a plurality of splines 82 that interlock or mate with a number of similarly configured splines (not shown) within one of the outer knuckles 110 of flip lid cover 40, such that the hinge pin 70 and the flip lid cover 40 rotate synchronously. The splines of barrel 72 are located within the inner surface of outer knuckle sections 110 associated with flip lid cover 40. The distal end of the first section 78 furthest from the head 74 has a protruded tang 84 that interacts with a plunger 94 when in rotation, as will be explained.

Referring to FIGS. 3-4 and 5A-5B, a switch base 86 is coupled to and disposed behind the hinge structure 64, in a position that may be located inside the wall or housing 58 on which the base 66 is hingedly attached. The switch base 86 has an inner end 88 insertable into hinge structure 64 and an outer end 90 disposed outside and adjacent to the hinge structure 64. The inner end 88 of switch base 86 is a generally oblong protrusion sized to be received within a correspondingly shaped opening in the hinge structure 64. The outer end 90 of the switch base 86 is a generally box-shaped structure which mounts against the outside of hinge structure 64. It is contemplated, however, that the inner end 88 and outer end 90 may have any shape and size as desired. When received within the hinge structure 64, the inner end 88 of switch base 86 is located closely adjacent the rotatable axle of hinge pin 70.

The switch base 86 has a cylindrical passage 92 therein for slidably receiving a plunger 94 in a direction toward the hinge structure 64. The plunger 94 is in the form of a cylindrical member that is insertable into the passage 92 of switch base 86, allowing it to pass through both outer end 90 and inner end 88 of switch base 86. The plunger 94 is sized to a length allowing it to protrude from the inner end 88 into hinge structure 64, and selectively outward from the outer end 90 onto a block contact 98.

With reference now to FIGS. 5A-5B and 7-8, a spring-suspended contact armature 96 is mounted to and located behind the switch base 86. The armature 96 is also interconnected between the multipole locking receptacle 46 and the non-GFCI duplex receptacles 50. The armature 96 is movable between a first and second position, as will be explained. In the first position, the multipole locking receptacle 46 is electrically connected to the power generating means of generator 10 to receive electrical power from the power generating means, and the non-GFCI duplex receptacles 50 are electrically disconnected from the power generating means of generator 10. In the second position, the multipole locking receptacle 46 is electrically disconnected from the power generating means of generator 10, and the non-GFCI duplex receptacles 50 are electrically connected to the power generating means of the generator 10 to receive electrical power from the power generating means of the generator 10.

The armature 96 consists of a contact arrangement having a block contact 98, which is movably engageable with plunger 94, and a stationary contact wall 102. The block contact 98 is biased toward the switch base 86 by a plurality of U-shaped springs 100 located on the opposite side of block contact 98 opposite switch base 86, and which provide a spring compression force between protruding tabs 112 of the block contact 98 and stationary contact wall 102. It is contemplated that other types of springs or cables may be used to create the biasing force. Electrical contacts 104, which may be in the form of electrically conductive metal, are located on the wall of block contact 98 facing toward the stationary contact wall 102. Contact springs 114 may be disposed within block contact 98 and behind electrical contacts 104. Corresponding electrical contacts 106 are disposed on the stationary contact wall 102 facing toward block contact 98 and disposed opposite from the electrical contacts 104 of the block contact 98. When the electrical contacts 104 of the block contact 98 are engaged with the electrical contacts 106 of the stationary contact wall 102, an electrical circuit is completed and power may be delivered to the outlets 50, as understood in the art. A plurality of fasteners 116 installed within the stationary contact wall 102 may further assist to couple the armature 96 and the stationary wall 103.

Figure 7:
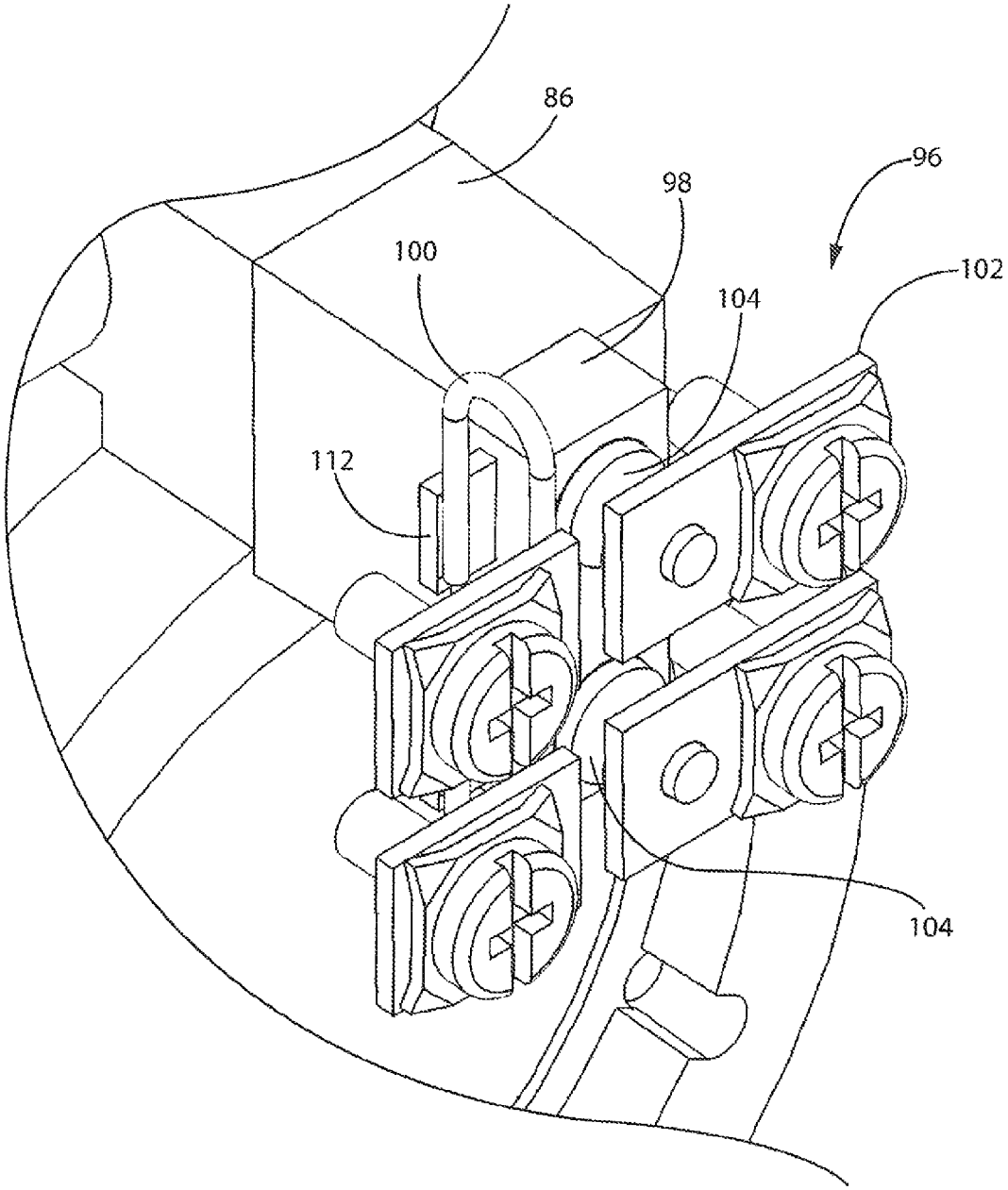
FIG. 7 is an enlarged partial isometric view of the contact assembly of FIG. 3 with the contact assembly in a deactivated position.

As seen in FIG. 7, when the plunger (hidden from view) is in a retracted position when flip lid cover 40 is open, the block contact 98 is retracted toward switch base 86 under the force of springs 100 and block contact 98 directly abuts the switch base 86. The electrical contacts 104 of block contact 98 are disengaged from the corresponding electrical contacts 106 of the stationary contact wall 102. When the contacts 104, 106 are disengaged in this manner, the electrical circuit is broken and power is not delivered to the outlets 50.

Figure 8:
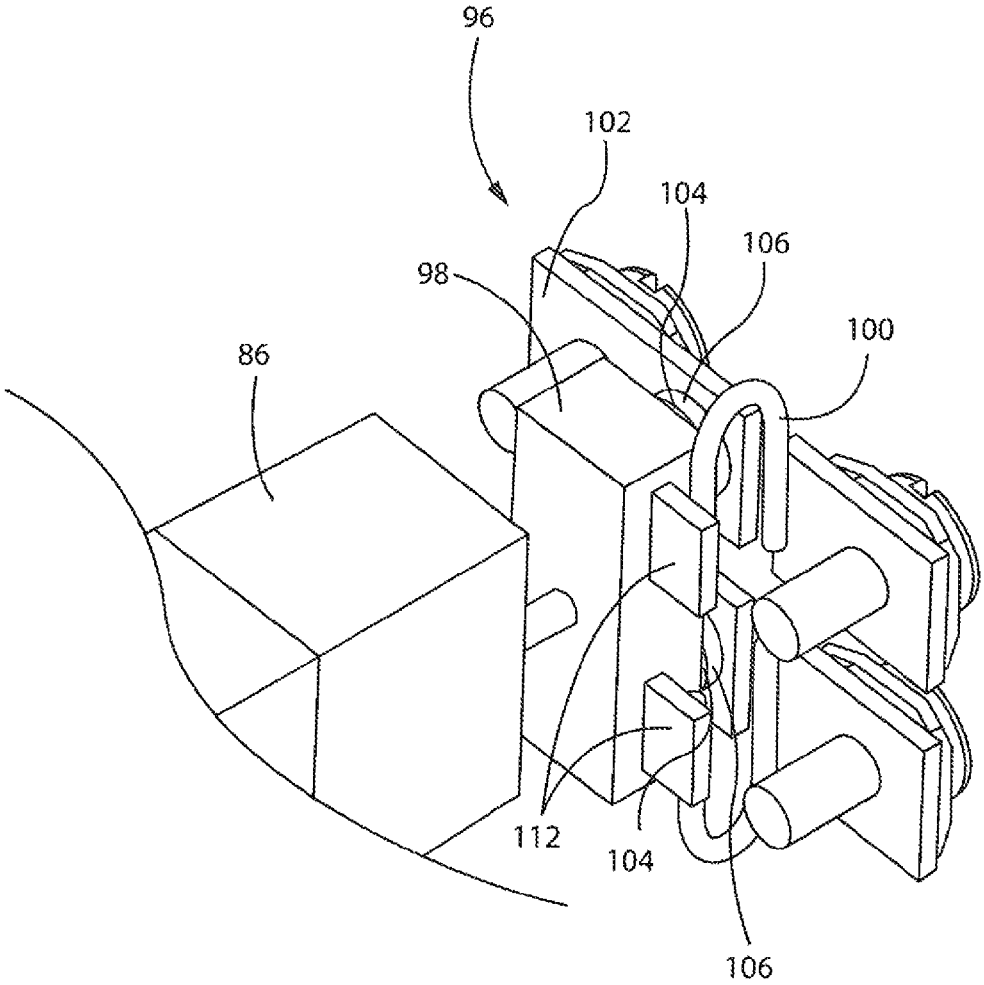
FIG. 8 is an enlarged partial isometric view of the contact assembly of FIG. 4 with the contact assembly in an activated position.

As seen in FIG. 8, when the plunger 94 is extended when flip lid cover 40 is closed, the block contact 98 is movably positioned toward the stationary contact wall 102 against the force of springs 100. The electrical contacts 104 of block contact 98 are engaged with the corresponding electrical contacts 106 of the stationary contact wall 102. When both electrical contacts are engaged, power may be delivered to the outlets 50.

Figure 9:
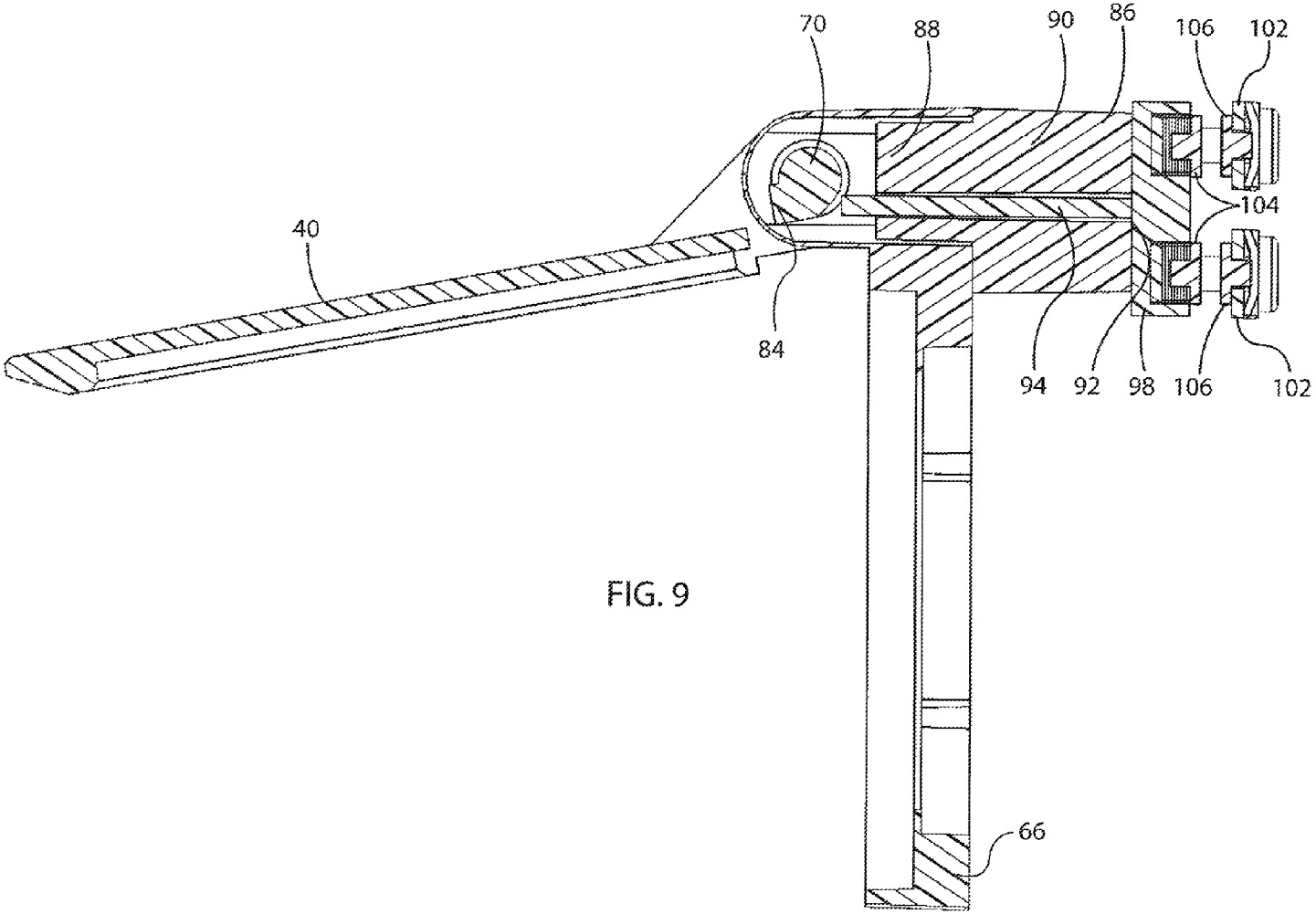
FIG. 9 is a partial section view of the contact and lid assembly of FIG. 3 showing the contacts disengaged.
Figure 10:
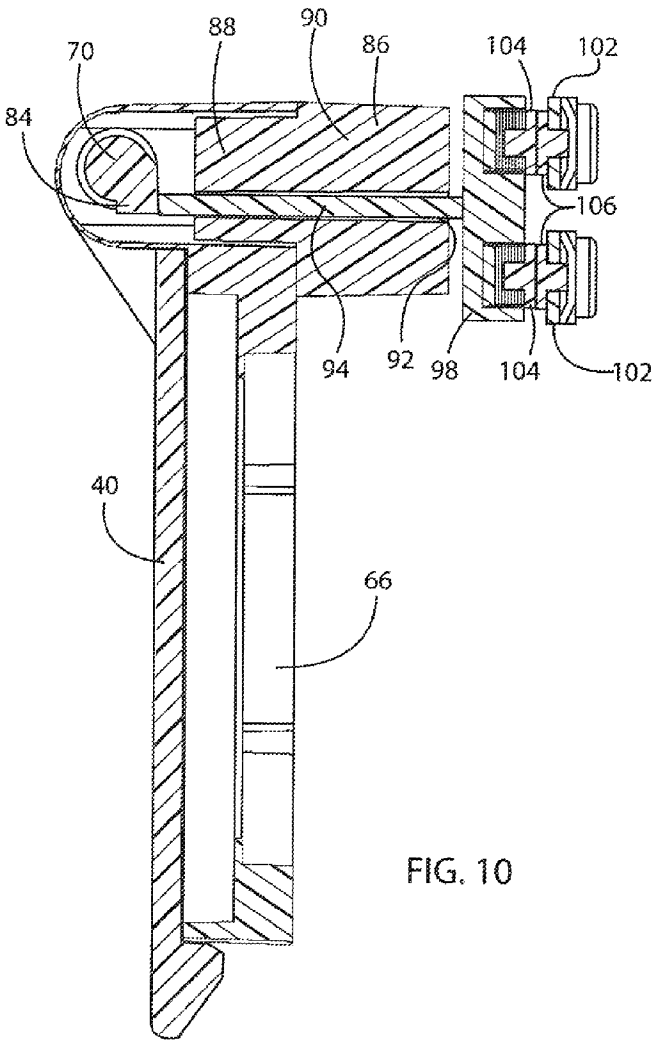
FIG. 10 is a partial section view of the contact and lid assembly of FIG. 4 showing the contacts engaged.

Referring now to FIGS. 9 and 10, which represent cross-sectional views of the inner end 88 of switch base 86 interacting with the hinge structure 64, and outer end 90 interacting with the block contact 98, it can be seen that the plunger 94 is selectively engageable with the axle of hinge pin 70. As seen in FIG. 9, when flip lid cover 40 is rotated to an open position, the hinge pin 70 is concurrently rotated such that the tang 84 protruding from hinge pin 70 does not contact the plunger 94. In this position, the plunger 94 is seen as being housed entirely within the passage 92 of the switch base 86 and does not exert a moving force on the block contact 98. As seen in FIG. 10, when flip lid cover 40 is rotated to a closed position, the hinge pin 70 is concurrently rotated such that the protruded tang 84 actuates the plunger 94 and the plunger 94 is slid in an outward direction. In this position, the plunger 94 protrudes from the outer end 90 of switch base 86 and exerts a moving force on the block contact 98.

In operation, the flip lid cover 40, hinge pin 70, plunger 94, and block contact 98 actuate or impede an electrical engagement of electrical contacts 106 of the stationary wall 102 with electrical contacts 104 of block contact 98 to provide a lock-out or disabling arrangement. As shown in FIGS. 8 and 10, when flip lid cover 40 is moved to a closed position, the hinge pin 70 is simultaneously rotated such that the protruded tang 84 actuates the plunger 94 to assume an extended position. In the extended position, the block contact 98 is moved toward the stationary contact wall 102, thus providing an electrical connection of the electrical contacts 104, 106 of the block contact 98 and the stationary wall to allow power to be supplied to duplex outlets 50. As shown in FIGS. 7 and 9, when the flip lid cover 40 is rotated to an open position, the hinge pin 70 is simultaneously rotated such that the protruded tang 84 does not actuate the plunger 94, and the plunger 94 resumes a retracted position within switch base 86 under the biasing force exerted by springs 100. With the plunger 94 in a retracted position, the block contact 98 is forced away from the stationary contact wall 102. Thus, the electrical contacts 104, 106 of the block contact 98 and the stationary wall are disengaged, thus breaking the electrical circuit and preventing power from being delivered to outlets 50.

It is understood that the flip lid interlock 62 may be applied to any outlet of the electrical generator 10. For example, the flip lid interlock 62 may be positioned over an outlet 50 and prevent power from being delivered to secondary outlets 50 of the generator 10 depending on the positioning of the lid cover 40. It is also understood that the flip lid interlock 62 may prevent power from being delivered to any combination of power outlets of the electrical generator 10. It is also contemplated that the flip lid interlock 62 may be adopted to be used with power receptacles that are not part of an electrical generator. It is also contemplated that the configuration may be reversed, in that a flip lid arrangement as shown and described may be positioned over the duplex receptacles 50 and configured to selectively prevent the supply of power to the multipole locking receptacle 46.

Many changes and modifications could be made to the invention without departing from the spirit thereof. The scope of these changes will become apparent from the appended claims.

We claim:

1. An electrical generator comprising:

a means for generating electrical power;

a first receptacle electrically connectable to the power generating means and adapted to engage a power plug associated with an electrical panel that controls a flow of electrical current to a plurality of loads;

a second receptacle electrically connectable to the power generating means and adapted to engage a power plug associated with an electrical device;

a movable contact arrangement interconnected between the first receptacle, the second receptacle, and the power generating means, the movable contact arrangement being movable between a first position in which the first receptacle is electrically connected to the power generating means to receive electrical power from the power generating means and the second receptacle is electrically disconnected from the power generating means, and a second position in which the first receptacle is electrically disconnected from the power generating means and the second receptacle is electrically connected to the power generating means to receive electrical power from the power generating means; and a flip lid covering one of the first and second receptacles and configured to move the movable contact arrangement the first position when the flip lid is open and the second position when the flip lid is closed.

2. The electrical generator of claim 1 further comprising a hinge pin permitting rotation of the flip lid between open and closed positions, wherein the hinge pin is simultaneously rotatable with the lid.

3. The electrical generator of claim 2 wherein the hinge pin has a protrusion acting on a plunger adapted to actuate the movable contact arrangement for movement between the first and second position.

4. The electrical generator of claim 3 wherein the plunger is retracted when the movable contact arrangement is in the first position.

5. The electrical generator of claim 3 wherein the plunger is extended when the movable contact arrangement is in the second position.

6. The electrical generator of claim 1 wherein the first receptacle is a multi-pole receptacle and the second receptacle is a non-GFCI receptacle.

7. A lockout arrangement to prevent simultaneous use of a first receptacle and a second differently configured receptacle of a portable generator, comprising:

a cover associated with the first receptacle that is rotatable between an open and a closed position to selectively disconnect power supply to the second receptacle; and a plunger coupled to and movable with rotation of the cover that disconnects power to the second receptacle when the cover is open and the plunger is in a first retracted position, and connects power to the second receptacle when the cover is closed and the plunger is in a second extended position.

8. The lockout arrangement of claim 7 wherein a hinge pin permits rotation of the cover and wherein the pin has a protrusion thereon adapted for moving the plunger between the first retracted position and the second extended position.

9. The lockout arrangement of claim 7 further comprising a contact armature interconnected between the first receptacle, the second receptacle, and a power generating means, wherein the armature is movable between a first position in which the first receptacle is electrically connected to the power generating means to receive electrical power from the power generating means and the second receptacle is electrically disconnected from the power generating means, and a second position in which the first receptacle is electrically disconnected from the power generating means and the second receptacle is electrically connected to the power generating means to receive electrical power from the power generating means.

10. The lockout arrangement or claim 9 wherein the plunger is retracted when the contact armature is in the first position.

11. The lockout arrangement of claim 9 wherein the plunger is extended when the contact armature is in the second position.

12. The lockout arrangement of claim 9 wherein the first receptacle is a multi-pole receptacle and the second receptacle is a non-GFCI receptacle.

13. A method of preventing simultaneous use of a first receptacle and auxiliary second differently configured receptacle of a portable generator comprising the steps of:

providing a lockout arrangement comprising:

a cover pivotably coupled to the first receptacle; and a plunger slidably disposed within a hinge of the cover and movable between retracted and extended positions;

coupling a power cord to the first receptacle wherein the cover is open and supply of power to the second receptacle is prevented; and disconnecting the power cord from the first receptacle wherein the cover is closed and supply of power to the second receptacle is provided.

14. The method of claim 13 wherein the hinge has a protrusion and wherein the protrusion acts upon the plunger to slidably move the plunger between retracted and extended positions.

15. The method of claim 13 wherein the lockout arrangement further comprises:

a contact armature interconnected between the first receptacle, the second receptacle, and a power generating means, the armature movable between a first position in which the main receptacle is electrically connected to the power generating means to receive electrical power from the power generating means and the second receptacle is electrically disconnected from the power generating means, and a second position in which the first receptacle is electrically disconnected from the power generating means and the second receptacle is electrically connected to the power generating means to receive electrical power from the power generating means.

16. The method of claim 15 further comprising the step of retracting the plunger to place the contact armature in the first position.

17. The method of claim 15 further comprising the step of extending the plunger to place the contact armature in the second position.

18. The method of claim 13 wherein the first receptacle is a multi-pole receptacle and the second receptacle is a non-GCFI receptacle.

* * * * *

UNITED STATES PATENT AND TRADEMARK OFFICE

CERTIFICATE OF CORRECTION

PATENT NO. : 9,118,139 B1
APPLICATION NO. : 14/203976
DATED : August 25, 2015
INVENTOR(S) : Michael O. Flegel et al.

It is certified that error appears in the above-identified patent and that said Letters Patent is hereby corrected as shown below:

IN THE CLAIMS

Claim 1, column 11, lines 25-26, after “arrangement” insert -- between --

Signed and Sealed this
Twenty-ninth Day of December, 2015

Michelle K. Lee

Michelle K. Lee
*Director of the United States Patent and Trademark Office*